United States Patent [19]

Cervantes

[11] 4,084,341

[45] Apr. 18, 1978

[54] DETACHABLE GUN LOCK

[76] Inventor: Ramon H. Cervantes, 4600 78th St., Sacramento, Calif. 95820

[21] Appl. No.: 727,574

[22] Filed: Sep. 28, 1976

[51] Int. Cl.[2] ..... F41C 27/10

[52] U.S. Cl. ..... 42/1 Y

[58] Field of Search ..... 42/1 LP, 1 Y

[56] References Cited

U.S. PATENT DOCUMENTS

| | | | |
|---|---|---|---|
| 2,512,140 | 6/1950 | Childs et al. | 42/1 Y |
| 2,742,726 | 4/1956 | Feller | 42/1 Y |
| 2,893,152 | 7/1959 | Peluso | 42/1 Y |
| 3,031,787 | 5/1962 | Womble, Jr. | 42/1 Y |
| 3,368,297 | 2/1968 | Lentz | 42/1 Y |

*Primary Examiner*—Charles T. Jordan

*Attorney, Agent, or Firm*—Blair & Brown

[57] ABSTRACT

A detachable gun lock having a back plate carrying a post which engages through the trigger guard of a handgun and cooperates with a combination lock controlled bolt to maintain the post in the trigger guard to prevent the weapon from being fired.

4 Claims, 5 Drawing Figures

DETACHABLE GUN LOCK

BACKGROUND OF THE INVENTION

FIELD OF THE INVENTION

The present invention relates to detachable gun locks which can be secured to the trigger guard of a handgun.

SUMMARY OF THE INVENTION

The present invention consists of a gun lock having a back plate carrying a post which can engage through the trigger guard of a handgun and the combination controlled bolt which cooperates with the post to secure the post within the trigger guard. A battery controlled light on the bolt is provided for illuminating the combination lock at night.

The primary object of the invention is to provide a detachable lock for handguns which renders the gun completely safe from accidential discharge by children or adults not processing the combination.

Other objects and advantages will become apparent in the following specification when considered in light of the attached drawings.

DESCRIPTION OF THE PREFERRED EMBODIMENT

Figure 1:
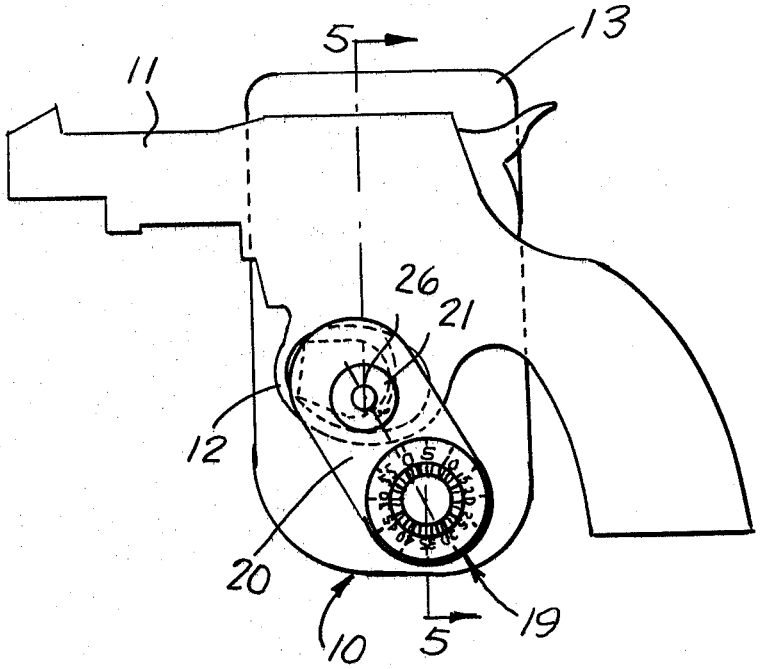
FIG. 1 is a side elevation of the invention shown attached to a handgun.

Referring now to the drawings in detail wherein like reference characters indicate like parts throughout the several Figures the reference numeral 10 indicates generally a detachable gun lock constructed in accordance with the invention.

The gun lock 10 is adapted to be used with a handgun such as that illustrated at 11 having a trigger guard 12 forming a part thereof. The detachable gun lock 10 includes an elongate back plate 13 having a rubber coating 14 on the outer surface thereof to prevent marring of the furniture.

A post 15 extends integrally upwardly from a boss 16 forming a part of the plate 13. The post 15 is adapted to engage in the trigger guard 12 of the handgun 11 and a set screw 17 in the post 15 is provided for establishing the snug fit of the post 15 in the trigger guard 12. A lock housing 18 extends integrally upwardly from the boss

16 parallel to the post 15. A combination lock is indicated generally at 19 and is mounted in the lock housing 18. The combination lock 19 has a bolt 20 associated therewith and mounted for pivotal movement into a position confronting the outer end of the post 15 when locked and into a position spaced from the post 15 when unlocked.

A light housing 21 is threaded into the bolt 20 and has a battery 22 mounted therein. A lamp socket 23 is slidably mounted in the housing 21 toward the battery 22 and a coil spring 24 normally urges the socket 23 away from the battery 22. A lamp 25 is mounted in the lamp socket 23 and a pushbutton 26 engages the top of the lamp 25 and extends outwardly through the upper end of the housing 21. Inward pressure on the push-button 26 forces the lamp 25 and socket 23 toward the battery 22 against the pressure of the spring 24 until the lamp 25 engages the battery 22 and is then energized. An opening 27 in the lower part of the housing 21 permits light from the lamp 25 to shine on the combination lock 19 so that it can be operated at night.

Figure 2:
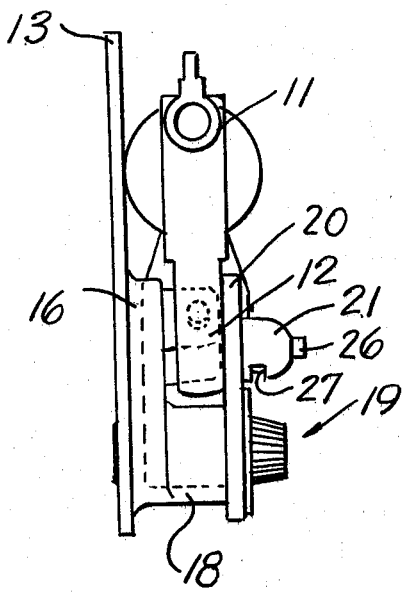
FIG. 2 is a front elevation of the invention shown attached to a handgun.
Figure 3:
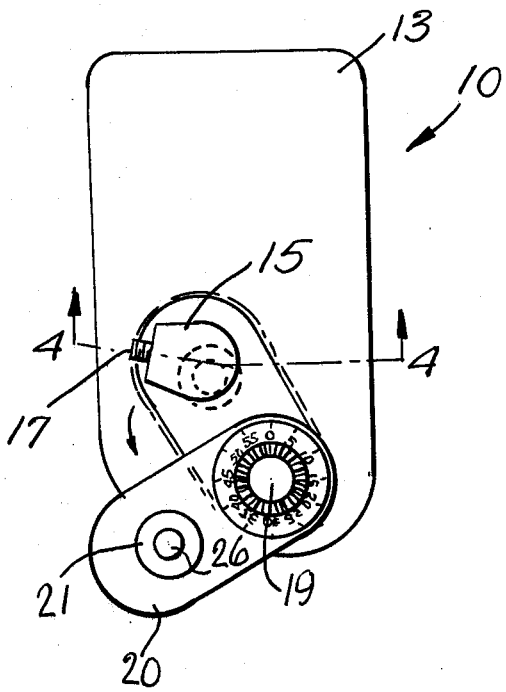
FIG. 3 is a front elevation of the invention detached from the handgun and in unlocked position.
Figure 4:
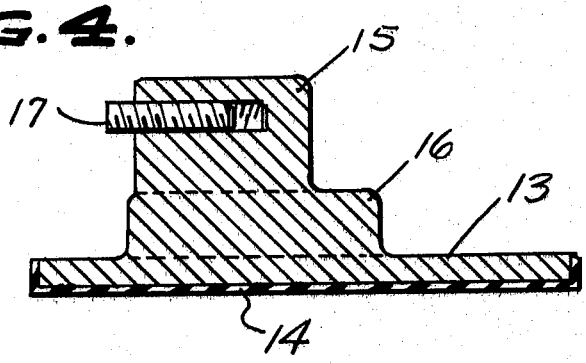
FIG. 4 is a fragmentary horizontal sectional view taken along the line 4—4 of FIG. 3 looking in the direction of the arrows.
Figure 5:
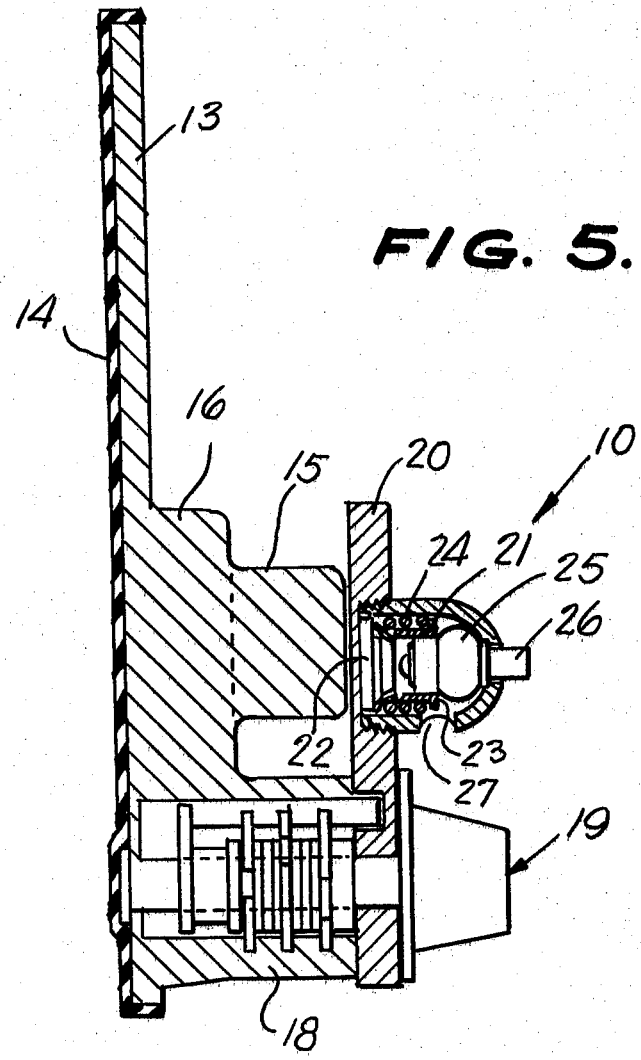
FIG. 5 is an enlarged fragmentary vertical sectional view taken along the line 5—5 of FIG. 1 looking in the direction of the arrows with the handgun omitted.

In the use and operation of the invention the combination lock 19 is actuated to release the bolt 20 so that it can be swung to the position illustrated in FIG. 3. The handgun 11 is then laid against the back plate 13 with the trigger guard 12 engaging around the post 15. The set screw 17 has been adjusted so as to cause the post 15 to snugly fit in the trigger guard 12. The bolt 20 is then swung to locked position as illustrated in FIGS. 1, 2 and 5 and the combination lock 19 is actuated to secure the bolt 20 in its locked position.

Having thus described the preferred embodiment of the invention it should be understood that numerous structural modifications and adaptations may be resorted to without departing from the spirit of the invention.

What is claimed is:

1. A detachable handgun lock comprising a back plate, a post extending integrally upwardly from said back plate and adapted to engage in a trigger guard of a gun, a lock secured to said back plate, a swingable bolt on said lock adapted to swing to a position confronting said post to secure said post in said trigger guard, said swingable bolt including a battery actuated light mounted on said bolt for illuminating said lock in the dark.

2. A device as claimed in claim 1 wherein said lock is a combination lock.

3. A device as claimed in claim 1 including adjustable means on said post for snugly fitting said post to said trigger guard.

4. A device as claimed in claim 1 wherein said back plate includes a rubber coating on the outer surface remote from said gun to prevent marring of furniture surfaces.

* * * * *